United States Patent [19]

Hoesterey

[11] 4,038,547

[45] July 26, 1977

[54] TRACKING AND SIGHTING INSTRUMENT

[75] Inventor: Howard F. Hoesterey, Santa Ana, Calif.

[73] Assignee: Philco Corporation, Dearborn, Mich.

[21] Appl. No.: 553,790

[22] Filed: May 31, 1966

[51] Int. Cl.[2] ..... F41G 11/00

[52] U.S. Cl. ..... 250/338; 250/203 R; 350/1; 244/3.11

[58] Field of Search ..... 350/33, 34, 169, 172, 350/173, 1, 2; 250/83.3 IR, 203, 338; 244/3.11, 3.16

[56] References Cited

U.S. PATENT DOCUMENTS 3,277,303 10/1966 Jensen et al. ..... 350/1 X

*Primary Examiner*—Verlin R. Pendegrass
*Attorney, Agent, or Firm*—Robert D. Sanborn

[57] ABSTRACT

Tracking and sighting apparatus for use in a missile guiding system. The apparatus receives visible light from a target, along with infrared light from the missile itself. Initially a beam splitter separates these different types of light. The beam splitter is followed by separate objectives, one of which is disposed in the path of infrared light and is highly transmissive and suitably refractive to this light, while the other objective is in the path for visible light and is highly transmissive and suitably refractive for this light. The two objectives focus the infrared and visible light, respectively, into a tracking receiver and a sighting ocular.

7 Claims, 3 Drawing Figures

INVENTOR.
HOWARD F. HOESTEREY

BY
Frank D. Prager
ATTORNEY

TRACKING AND SIGHTING INSTRUMENT

This invention relates to apparatus for guiding a missile to a target. Apparatus of this kind comprises tracking and sighting devices which utilize infrared tracking signals from the missile, and visible signals from the target, to guide the missile to the target. The invention deals with the means for handling these signals in the tracking and sighting devices.

In the most advanced prior apparatus of this type, a single lens unit was used to focus the infrared signals, and the visible ones, into separate receiver and ocular units. In copending application No. 707,355 filed on Feb. 2, 1968, and now U.S. Pat. No. 3,598,344 and owned by the assignee of the present invention, such a single focusing lens unit was shown. It was disposed on the axis along which the two types of signals jointly arrive when guidance of the missile to the target is completed.

Such unified or joint focusing of the infrared and visible signals was advantageous as it minimized bulk, weight and cost of optical elements used in the sighting and tracking system. However, such focusing tends to prevent the systems from performing its tracking and sighting operations to best advantage. The reason is that the focusing of visible light required in apparatus of the indicated type, is most effectively done by a lens which is highly corrected and achromatized for such light; such a lens, however, is not as transparent to infrared energy as is desirable for the tracking of a remote missile.

It is an object of this invention to handle the jointly arriving infrared and visible signals more effectively than was done in the past with respect to correction, achromatizing, and utilization of signals from remote missiles. For this purpose the invention provides separate focusing of the infrared and visible signals. A distinct improvement in effectiveness of the sight and tracker has been obtained by the use of this invention. A preferred embodiment of the invention comprises a beam splitter, particularly a dichroic mirror transmitting infrared energy and reflecting visible light; a tracking system wherein infrared radiation from the missile is focused by a suitable lens into the region of a tracking detector; an objective telescope lens, highly corrected and achromatized for visible light from the target; and a telescope ocular cooperating with this objective lens.

According to a further and more specific object of the invention the new tracking system includes a check sight assembly, suitable for use in conjunction with the separate optical paths as outlined. A source of suitably modulated infrared light is combined with a prism or the like which can be inserted in and removed from a region between this modulated source and the infrared focusing means of the new instrument, to provide a known degree of diversion of modulated infrared energy, and thereby to allow comparison of a known signal diversion value with characteristics of the incoming and separately focused tracking signals.

The new system will be understood more clearly on review of the following description of a simple and preferred embodiment of the same, with reference to the drawing, wherein.

Figure 1:
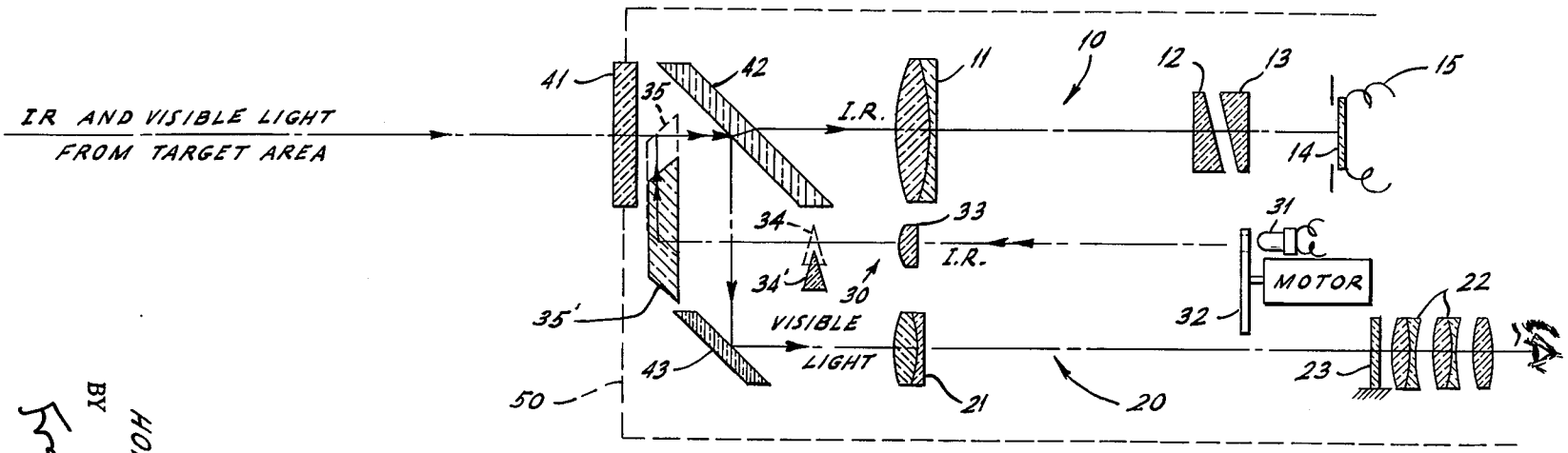
FIG. 1 is a schematic side view, in central section, of said preferred embodiment.

As shown in FIG. 1 there is provided a tracking system 10 wherein infrared light or radiation (IR) is focused with minimum absorption. Also provided is a separate sighting system 20, wherein visible light is focused. Preferably these systems 10 and 20 have optical axes maintained in close parallelism by suitable mounting of the two units in a rigid housing 50. The housing is mounted on or near a missile-launching station, either stationary or moving, for guiding the missile to a remote stationary or moving target.

Figure 2:
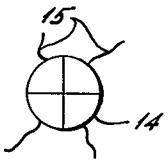
FIGS. 2 and 3 are schematic front views of certain elements of this system.

Tracking system 10 includes a lens or achromat 11, of known type, for passing and focusing near-infrared energy, for instance of 0.65 to 1.1 micron wavelengths, which can be derived for instance from the heat radiated by the propulsion nozzle of the missile. Lens or achromat 11 can be constructed for instance by suitably combining elements of different calcium aluminates or the like. The lens focuses the infrared energy, through relatively movable achromatic wedge or prism elements 12, 13, onto tracking detector 14. A front view of this detector is shown in FIG. 2. It may comprise a semiconductive unit of quadrant type, which is also shown in copending application No. P 36934 and need not be described in detail herein. Wedge elements 12, 13 preferably are constructed for generally conjoint rotary motion to nutate the infrared signal on the surface of detector 14, and also for angular motion of one element relative to the other to maintain proper radius of the path of the infrared signal, nutating or rotating over this surface, while the flying missile recedes from the launching site. Means for effecting such conjoint and relative rotation are not shown herein, such means being known from copending application No. 456,606, based on an invention of Cade and the present inventor, which copending aplication was filed on May 12, 1965, and is assigned to the assignee of the present invention.

Sighting system or telescope 20 comprises an objective achromat lens 21 and an ocular 22. The objective lens is highly transparent to visible light, for example to energy of about 0.3 to 0.6 micron wavelength. Such a lens is advantageously made for instance from glasses of the various types often designated as crown glass and flint glass, suitably matched and carefully ground for high geometrical and chromatic correction. As noted above, such a unit is less than ideally transparent to infrared light. In the new instrument, however, the lack of high infrared transparency, in optical achromat 21, no longer interferes with maximum response to infrared signals from remote objects, as the invention provides separate infrared focusing system 10, described above.

Figure 3:
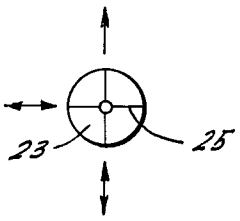

Optical ocular 22 can be made in conventional ways, well known to persons skilled in the art. It has reticle 23 in its focus, this reticle having for instance cross-hairs or cross-lines 25 as shown in FIG. 3. The operator of the new instrument observes the remote target (far at left of the apparatus shown in FIG. 1) through optical telescope 20. He applies small successive motions to instrument housing 50 to keep the target centered on reticle 23 of this telescope. These motions have the effect of producing relative motion between the infrared detector 14 and the signals received and focused thereon. Such relative motion, in turn, produces electric error signals in detector conductors 15, and these error signals are used, by means of transmitting and receiving apparatus not shown herein, to correct the flight direction of the missile.

Instrument housing 50 has an infrared check sight system 30 mounted therein for periodic recalibration and adjustment of the infrared tracking and detecting system. This check sight comprises source 31 of infrared light; motorized chopper 32 in front of this source; lens 33 to collimate the chopped infrared light, and combined prism elements 34, 35 for adjusting the collimation of this light and directing the adjusted, collimated, chopped, infrared light into infrared focusing element 11 of tracking system 10. Adjusting means 34, as shown, comprises a small prism movable across the axis of the check sight, between positions 34 and 34', this motion being obtained by well known micrometer means, not shown, and being utilized in order to introduce a known degree of refractive diversion into the collimated infrared light of the check sight.

The operation of additional prism 35 can be described most easily in connection with the more fundamental operation of the entire device, which is as follows. The infrared and visible signals from the missile and target area are received in instrument housing 50 through window 41 and in a direction normal thereto, and are then separated by beam splitter 42. Advantageously this beam splitter comprises a dichroic mirror transmissive of infrared energy and reflective to visible light, and which is disposed at 45 degrees to window 41 as shown. Visible light is reflected from the front of this dichroic mirror, at right angles to the direction of the incoming signals, to a plain reflector 43 mounted in the front portion of the instrument and parallel to the dichroic mirror, so that the visible light then enters telescope 20 in a direction parallel to the direction of the incoming signals. The infrared signals pass through the dichroic mirror with insignificant lateral displacement, as indicated in the drawing, and continue in the general direction of the incoming signals, through infrared tracker 10.

Returning to check sight prism 35: this element, when actually used for operation of the check sight, is in position 35 shown in broken lines, wherein an oblique surface, at right angles to dichroic mirror 42, is positioned between this dichroic mirror and window 41. Element 35 is shown as being constructed in the form of a Porro prism and has a second inclined surface at right angle to the first mentioned one, which second surface in the broken line position of the element receives the adjusted, collimated, infrared light from source and chopper 31, 32 and deflects the same through the Porro prism to the first mentioned inclined surface, wherefrom this infrared light is reflected into dichroic mirror 42 and tracker 10. When the operation of the check sight has been completed, Porro prism 35 is retracted a small distance into full line position 35', wherein the adjusted collimatd light of the check sight no longer is reflected but simply passes through the prism without further use.

Introduction of the chopped, collimated, and adjusted check sight signals into tracker 10 produces electric signals in detector wires 15. The frequency, phase, strength, and other characteristics of these signals can be compared with the corresponding characteristics of the signals produced in the tracker by the infrared energy from the missile.

It will be understood that optical elements 41, 42, 43, 11, 21 and 22 generally can be mounted in instrument housing 50 by rigid mounting means, not shown, or by mounting means providing only for minor or micrometer adjustment. Therefore this entire tracking and sighting system, and the elements thereof, can be kept in proper and accurate alignment, even in the presence of serious vibration of the entire instrument and other similar sources of trouble which frequently interfered with former instruments. While mobile mounting is needed for check sight elements 32, 34, and 35, the mobility of these elements does not interfere with the normal use of the apparatus, it being possible in most cases to perform the check sight operation, described above, at times when vibration and similar disturbances are at a minimum.

While only a single embodiment of the invention has been fully described, the details thereof are not to be construed as limitative of the invention. The invention contemplates such variations and modifications as come within the scope of the appended claims.

I claim:

1. Missile tracking and target sighting apparatus of the type which receives conjoint, generally parallel beams of incident visible and infrared light, coming respectively from a target and a missile, said apparatus comprising means for initially splitting the incident conjoint light beams into separate beams of infrared and visible light respectively; a first objective, disposed in the path of the visible light beam and focusing the light thereof into target-sighting ocular means; and a second and separate objective, disposed in the path of the infrared light beam and focusing the light of the latter beam into missile-tracking receiver means, said first and second objectives being highly transmissive, respectively, to visible light and to infrared light.

2. Apparatus as described in claim 1, wherein at least one of said objectives is a lens highly corrected and achromatized for focusing the respective light.

3. Apparatus as described in claim 1, wherein each objective is a lens highly corrected and achromatized for focusing the respective light.

4. Apparatus as described in claim 1, wherein the means for initially splitting the light beams is a dichroic mirrorfilter.

5. Apparatus as described in claim 1 including a pair of optical wedges rotatable conjointly and also rotatable one relative to the other between said separate objective and said tracking device.

6. Missile tracking and target sighting apparatus comprising means for splitting incident, conjointly arriving, visible and infrared radiations into separate visible and infrared light beams; objective lens means disposed in the path of the visible light beam and to focus the same into sighting apparatus; separate objective lens means disposed in the path of the infrared light beam and to focus the same into tracking apparatus; and a check sight including an infrared source, means for selectively guiding energy from said source onto said separate objective or withholding it therefrom, and means between said source and said separate objective for modulating energy from said source.

7. Apparatus as described in claim 6 wherein the last mentioned means comprises a prism shiftable across the optical axis of the check sight.

* * * * *